US009914167B2

(12) United States Patent
Shan et al.

(10) Patent No.: US 9,914,167 B2
(45) Date of Patent: Mar. 13, 2018

(54) METHOD OF PRE-CONTROLLING SHAPES OF CONTINUOUS-CASTING SLAB HEAD AND TAIL FOR REDUCING HEAD AND TAIL CUT AMOUNT OF HOT ROLLING INTERMEDIATE SLAB

(75) Inventors: Xuyi Shan, Shanghai (CN); Suoquan Zhang, Shanghai (CN); Li Huang, Shanghai (CN); Hongru Ding, Shanghai (CN); Ziqiang Wang, Shanghai (CN); Weilin Zhu, Shanghai (CN); Quansheng Wang, Shanghai (CN)

(73) Assignee: BAOSHAN IRON & STEER CO., LTD., Shanghai (CN)

( * ) Notice: Subject to any disclaimer, the term of this patent is extended or adjusted under 35 U.S.C. 154(b) by 440 days.

(21) Appl. No.: 14/236,609

(22) PCT Filed: Mar. 14, 2012

(86) PCT No.: PCT/CN2012/072299

§ 371 (c)(1),
(2), (4) Date: Mar. 5, 2014

(87) PCT Pub. No.: WO2013/123682

PCT Pub. Date: Aug. 29, 2013

(65) Prior Publication Data

US 2014/0352504 A1 Dec. 4, 2014

(30) Foreign Application Priority Data

Feb. 21, 2012 (CN) ..... 2012 1 0038624

(51) Int. Cl.
*B22D 11/126* (2006.01)
*B22D 11/16* (2006.01)
(Continued)

(52) U.S. Cl.
CPC ..... *B22D 11/126* (2013.01); *B22D 11/163* (2013.01); *B21B 1/466* (2013.01); *B21B 2015/0014* (2013.01); *Y10T 83/04* (2015.04)

(58) Field of Classification Search
CPC ..... B22D 11/126; B22D 11/163; B21B 1/466
(Continued)

(56) References Cited

U.S. PATENT DOCUMENTS 4,848,127 A * 7/1989 Isobe et al. ..... B21B 1/024 72/206
5,133,205 A * 7/1992 Rostik et al. ..... B21B 1/463 72/190

FOREIGN PATENT DOCUMENTS

CN 1439464 A 9/2003
CN 101670372 A 3/2010
(Continued)

OTHER PUBLICATIONS

International Search Report dated Nov. 29, 2012, for PCT Application No. PCT/CN2012/072299 (3 pages).

*Primary Examiner* — Kevin P Kerns
(74) *Attorney, Agent, or Firm* — Kilpatrick Townsebd & Stockton LLP

(57) ABSTRACT

A method of pre-controlling the shapes of a continuous-casting slab head and tail for reducing the cut amount of the head and tail of the hot rolling intermediate slab. The continuous-casting slab head and tail, is cut into a shape such that an end surface of the head concaves inwards and the tail projects outwards. The head and tail of a slab is cut in a curve that is symmetric to the center line in width thereof. Arc height, i.e. a maximum value of the concave amount at the head or that of the projection amount at the tail, is controlled within 0 mm-50 mm.

3 Claims, 5 Drawing Sheets

(51) Int. Cl.
*B21B 1/46* (2006.01)
*B21B 15/00* (2006.01)

(58) Field of Classification Search
USPC ..... 164/460, 452, 454; 29/527.6
See application file for complete search history.

(56) References Cited

FOREIGN PATENT DOCUMENTS

| | | | |
|---|---|---|---|
| CN | 201684903 | U | 12/2010 |
| DE | 10318286 | B3 | 10/2004 |
| JP | 55-153602 | A | 11/1980 |
| JP | 56-4301 | A | 1/1981 |
| JP | S57-39841 | B2 | 8/1982 |
| JP | 8-309401 | A | 11/1996 |

* cited by examiner

METHOD OF PRE-CONTROLLING SHAPES OF CONTINUOUS-CASTING SLAB HEAD AND TAIL FOR REDUCING HEAD AND TAIL CUT AMOUNT OF HOT ROLLING INTERMEDIATE SLAB

This application is a U.S. National Phase of International Application No. PCT/CN2012/072299, filed Mar. 14, 2012, which claims priority to the Chinese Patent Application No. 201210038624.3, filed Feb. 21, 2012, the disclosures of which are incorporated by reference herein.

FIELD OF THE INVENTION

The present invention relates to a method of pre-controlling the shapes of continuous-casting slab head and tail.

BACKGROUND OF THE INVENTION

With the continued improvement of the continuous casting—hot rolling process, hot rolling slabs are changed from original blooms to continuous-casting slabs. Usually, over 90% of hot rolling slabs come from the continuous casting.

During continuous casting, molten steel is poured, solidified and cut, and after this, the cut continuous-casting slab is sent into the hot rolling line to be rolled. Currently, the method of cutting a continuous-casting slab into cuboids is used internationally.

A conventional hot continuous rolling production line consists of a heating furnace, a rough rolling equipment, a finishing rolling equipment, a laminar cooling equipment and a coiler equipment, wherein in the region of the rough rolling equipment, there are provided with a roll table, a descaling machine, a slab fixed width press, a rough mill, a measuring meter and the like. Usually, the rough mill consists of a horizontal mill and an auxiliary edger mill, and it can perform rolling reversibly, so as to reduce the thickness or width of the slab. A typical layout of rolling line equipments is shown in FIG. 1.

The temperature drop during hot rolling has a substantial impact on the material properties and the rolling stability. For guaranteeing the rolling temperature during the finishing rolling, the whole line has to manufacture with the minimum passes and the highest speed so as to reduce the heat loss. If processing times in a device is an even number, there must be one dummy pass, which may result in a meaningless temperature drop. For reducing the temperature drop of material as much as possible, the process times in a rolling device must be always an odd number. For a production line configured with two rough mills (R1, R2), the passes of R1/R2 may be 1/5, 3/3 and the like.

Due to the odd characteristic of the process and the effect of the edger rolling, the deformation of the head and the tail of the material is asymmetric, which, in turn, causes the asymmetry between the shapes of the processed head and tail. A typical cuboid slab after processing by rough rolling equipments may be formed into an intermediate slab with a fishhead and a dovetail, as shown in FIG. 2.

During finishing rolling of hot rolling thin strip steels, a high speed rolling technique is utilized to improve the utilization efficiency of the equipments and reduce the temperature drop. The irregular shapes of the head and the tail of the intermediate slab after rough rolling may cause accidents when the material enters into the finishing mill, for instance, the head cannot pass through rollers smoothly, or the tail cannot be rolled stably. In view of this, a set of flying shear is provided between the rough mill and the finishing mill to cut away the irregular parts of the head and tail of the intermediate slab, which may cause the yield loss during production, affecting the production efficiency of the hot rolling line. Empirically, the loss for cutting the head and tail of the intermediate slab accounts for about 30% of the hot rolling yield loss. Assuming that the length of the intermediate slab is 60 m, and the head and the tail are cut by 150 mm respectively, the total cut amount is 300 mm, accounting for 0.5% the whole material. Therefore, improving the shapes of the head and tail and decreasing the cut amount thereof is one significant subject for iron & steel enterprises.

To improve the shapes of head and tail of the intermediate slab after rough rolling and increase the yield of the hot rolling line, the skilled have developed a lot of equipments and control techniques. For instance, large side press equipments for slab are used for pressing in width, and the pass of vertical rollers in the rough rolling region is controlled by using short head and tail stroke control method, so as to improve the shape of the head and tail. But even if a variety of methods have been used, the yield loss resulted from the bad head and tail shapes of the intermediate slab is still a main problem.

SUMMARY OF THE INVENTION

The objective of the present invention is to provide a method of pre-controlling the shapes of continuous-casting slab head and tail for reducing the cut amount of the head and tail of the hot rolling intermediate slab. The method can substantially decrease the length of the uneven deforming parts at the head and tail of the intermediate slab, thereby reducing the cut amount thereof.

To achieve the aforementioned objective, the present invention takes the following technical solution:

A method of pre-controlling the shapes of continuous-casting slab head and tail for reducing the cut amount of the head and tail of the hot rolling intermediate slab, which adopts the way of pre-controlling to cut the continuous-casting slab head and tail, that is, cutting the slab into the shape—the end surface of its head concaving inwards and that of its tail projecting outwards.

The head shape of the slab matches with the tail shape of the former one, and the tail shape of the slab matches with the head shape of the latter one, i.e. the former and latter slabs are cut from the same continuous-casting slab.

The method adopts the way of pre-controlling to cut the continuous-casting slab head and tail, that is, cutting the slab head and tail in a curve which is symmetric to the center line in width thereof; the arc height H, i.e. the maximum value of the concave amount at the head or that of the projection amount at the tail is controlled within 0 mm-50 mm.

According to the usual situation that the head of the hot rolling intermediate slab projects outwards and the tail thereof concaves inwards, the present invention, through inverse compensation principle, provides a method of pre-controlling the shape of the continuous casting slab head and tail to make the end surface of the head concaving inwards and that of the tail projecting outwards, which remarkably shortens the length of the irregular parts of the intermediate slab after being rolled by the rough rolling equipments, thereby decreasing the cut amount of the head and tail and improving the yield. The present invention changes the current method of cutting the continuous-casting slab in a straight line.

Comparing the controlling method according to the present invention with the prior art, the beneficial effects of the present invention is that:

(1) The method of pre-control cutting according to the present invention can reduce the loss due to cutting the head and tail. Tests have shown that the method can reduce the cutting loss of the head and tail by 20 mm respectively, i.e. the cut length at the head and tail can be reduced from 300 mm to 260 mm, by 13.3%, while increasing by about 0.05% the general yield. For an enterprise which has an annual production of 10 million tons of hot rolling strip steel, the cut amount can be reduced by 5 thousand tons per year. Assuming that the benefit for one ton is 2000 yuan (RMB), it can produce benefit 10 million yuan (RMB) per year. Meanwhile, it has remarkable effect of energy conservation.

(2) The method according to the present invention has no impact on the yield of the material in the continuous casting region.

(3) The method according to the present invention can be achieved through making suitable modifications to the cutting devices of continuous-casting slab.

DETAILED DESCRIPTION OF THE INVENTION

Thereinafter the present invention will be described in conjunction with the drawings and detailed embodiments.

Figure 1:
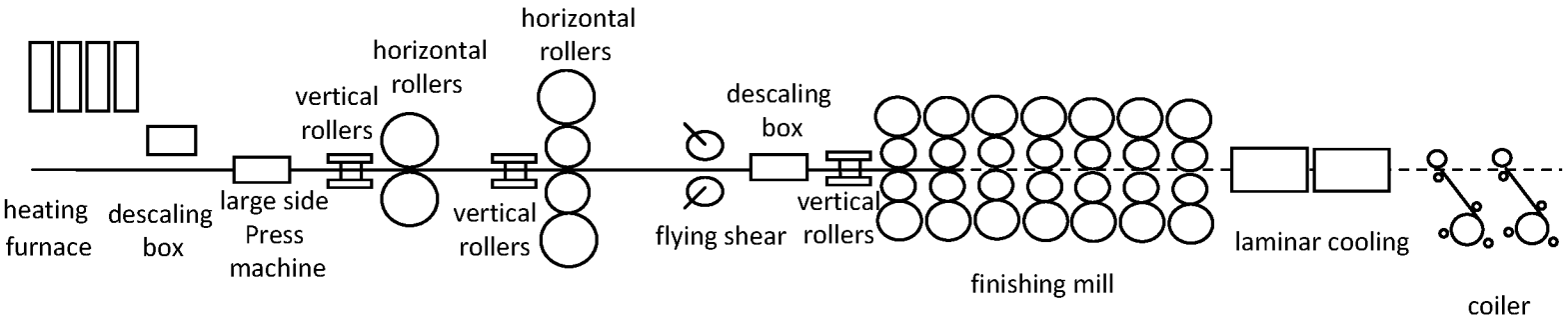
Fig. 1 (Prior Art)
FIG. 1 is the schematic view of the configuration of the equipments in a conventional hot rolling line.
Figure 2:
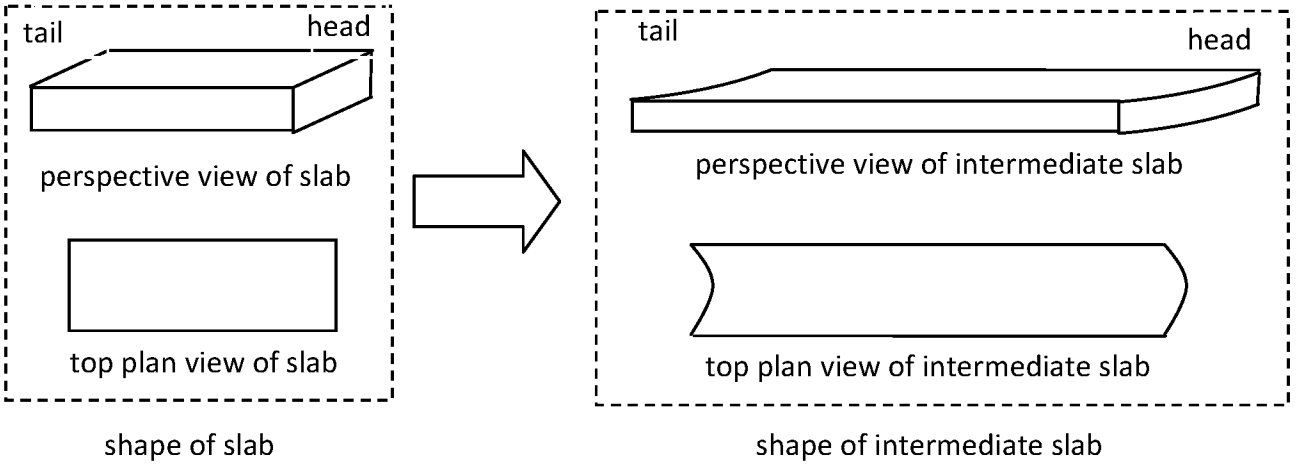
Fig. 2 (Prior Art)
FIG. 2 is the schematic view showing the deformation of the material head and tail before and after rough rolling.
Figure 3:
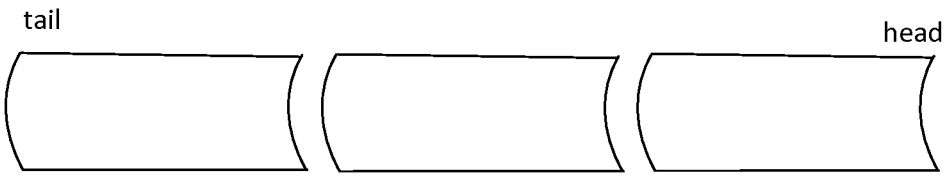
FIG. 3 is the schematic view of the pre-control method for the shape of the head and tail of the continuous-casting slab (the top plan view of the slab) according to the present invention.

With reference to FIG. 3, a method of pre-controlling the shapes of continuous-casting slab head and tail for reducing the cut amount of the head and tail of the hot rolling intermediate slab, adopts the way of pre-controlling to cut the continuous-casting slab head and tail, that is, cutting the slab into the shape—the end surface of the head concaving inwards and that of the tail projecting outwards.

The head shape of the slab matches with the tail shape of the former one, and the tail shape of the slab matches with the head shape of the latter one, that is, the former and latter slabs are cut from the same continuous-casting slab.

The irregular deformation of the head and tail of the slab during hot rough rolling has a certain relationship with the factors such as the width, the rolling reduction in width, the thickness, the rolling reduction in thickness, the heating temperature of the slab, the steel grade, the load distribution of each frame, wherein the total rolling reduction in thickness, the width and the rolling reduction in width have the largest impact on the shape of the head and tail.

Although the accurate dimension data of the final products cannot be obtained yet during cutting the continuous-casting slab, and the thickness and the width of the hot rolling intermediate slab can neither be confirmed, the thickness of the intermediate slab in a hot rolling line is kept within a certain range, according to which the thickness reduction ratio of the slab in the rough rolling region can be obtained. The range of a intermediate slab in a conventional hot rolling line is usually within 35 mm-65 mm, and assuming that the thickness of the continuous-casting slab is 230 mm, the rolling reduction ratio of the slab in the rough rolling region is about 3.5-6.5, thereby the pre-controlling amount can be confirmed. The specific pre-controlling shape thereof needs to be determined according to the function of the cutting machine.

During manufacturing slabs in the continuous casting line, the head of the first continuous-casting slab can be cut according to the pre-controlling method of the present invention or according to the existing way of straight line; similarly, the tail of the last continuous-casting material can be cut according to the pre-controlling method of the present invention or according to the existing way of straight line. The slabs from the second one to the penultimate one are cut using the method for pre-controlling the shapes of the continuous-casting slab head and tail in accordance with the present invention, thereby the length of the irregular parts at the head and the tail of the intermediate slab after rough rolling is remarkably reduced, the head and tail cut amount drops and the yield is improved.

The method for pre-controlling the shapes of the continuous-casting slab head and tail will be described in detail thereinafter.

Figure 4:
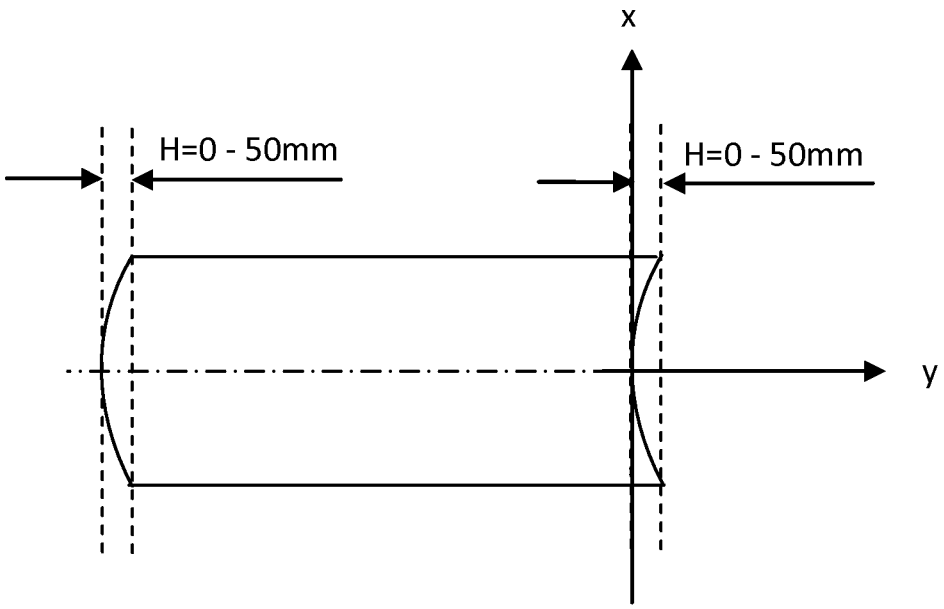
FIG. 4 is the schematic view of the curve cutting method according to the present invention.

1. The curve line pre-control method—cutting the continuous-casting slab head and tail in a curve which is symmetric to the center line in width of the slab to achieve the objective of compensating uneven deformation of the head and the tail. The arc height H, i.e. the maximum value of the head concaving inwards or the tail projecting outwards, is controlled within 0 mm-50 mm, as shown in FIG. 4; the range of the preferred arc height H is 15 mm-30 mm.

This solution is suitable for the case that the cutting machine for the continuous-casting slab can adjust the cutting curve based on the width and assure the arc height.

The curve line may be a circle arc, an ellipse arc, a sine curve, a polynomial curve or the like.

Taking the circle arc line control method as an example, the cutting curve can be determined by the slab width W and its arc height H. Herein the slab head shape calculation is taken as an example, which is the same as the slab tail shape calculation; assuming that the coordinates of the arc top are (0,0), and the distance between a position and the center line in width is x as shown in FIG. 4, the displacement y of the position relative to the arc top coordinates (0,0) may be calculated according to the following expression:

$$y = \frac{H^2 + W^2/4}{2H} - \sqrt{\left(\frac{H^2 + W^2/4}{2H}\right)^2 - x^2}\text{, wherein } -\frac{W}{2} \le x \le \frac{W}{2}.$$

Figure 5:
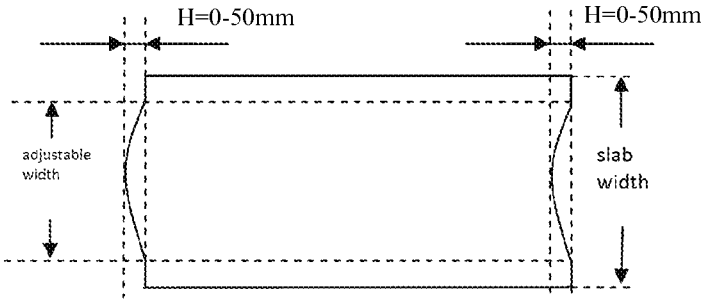
FIG. 5 is the schematic view of the straight and arc line cutting method according to the present invention.

2. The straight and arc line pre-control method. If the continuous-casting slab cutting machine cannot control to cut in a curve line based on the width of the slab, the straight and arc line pre-control method may be used. When the slab is wide, in the adjustable width in the middle part, the head and the tail of the slab may be cut according to the arc line pre-control method, and the two sides can be cut in a straight line. The two parts combine together to form the head and tail shapes, as shown in FIG. 5.

Figure 6:
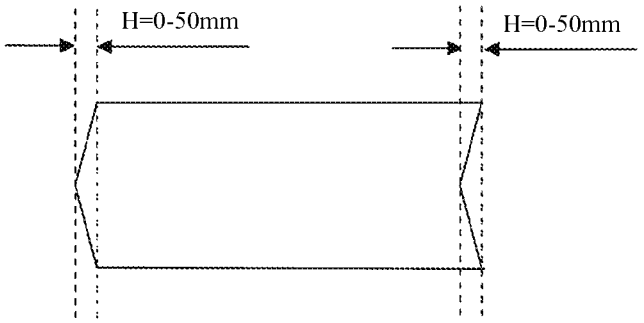
FIG. 6 is the schematic view of the broken line cutting method according to the present invention.

3. The broken line cutting method 1. In consideration of the convenience of cutting the continuous-casting slab, the broken line cutting method may be used, as shown in FIG. 6. The cutting line can be determined based on the width W and the arc height H of the slab. Herein the calculation of the slab head shape is taken as an example, which is the same as that of the slab tail shape; assuming that the coordinates of the head top are (0, 0) and the distance between a position and the center line in width is x, the displacement y of the position relative to the slab head top coordinates (0, 0) may be calculated according to the following expression:

$$y = \frac{2H}{W}\text{abs}(x), \text{ wherein } -\frac{W}{2} \le x \le \frac{W}{2}.$$

4. The broken line cutting method 2.

Figure 7:
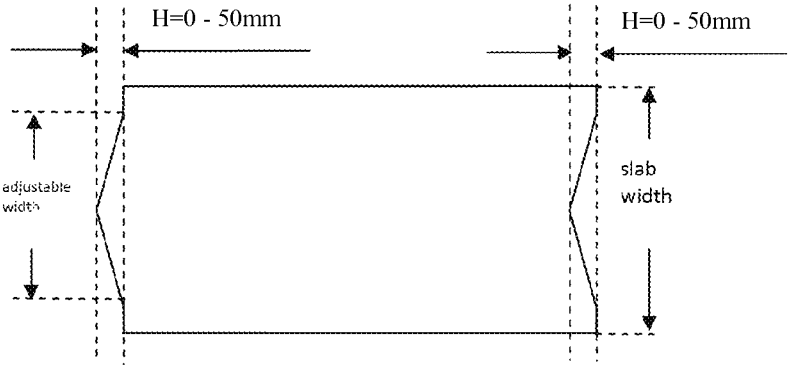
FIG. 7 is the schematic view of the straight and broken line cutting method according to the present invention.

In consideration of the stability of the rough rolling, on basis of the broken line cutting method 1, the two sides of the shape are cut into straight lines according to the broken and straight line pre-control method. When the slab is wide, in the adjustable width in the middle part the head and tail of the slab may be cut according to the broken line pre-control method and the two sides can be cut in a straight line. The two parts combine together to form the head and tail shapes, as shown in FIG. 7.

Figure 8:
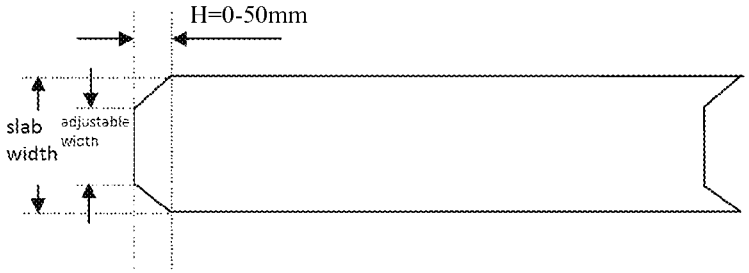
FIG. 8 is the schematic view of the trapezoid line cutting method according to the present invention.

5. The trapezoid pre-control cutting method. As shown in FIG. 8, the cutting line can be determined on basis of the width W, the adjustable width W', and the arc height H of the slab. Herein the slab head shape calculation is taken as an example, which is the same as the slab tail shape calculation; in the adjustable width in the middle part, the head and tail of the slab is cut along a straight line according to the trapezoid pre-control cutting method, and the two sides thereof is cut along an inclined line. The two parts combine together to form the head and tail shapes. Assuming that the coordinates of the middle position of the head top are (0,0) and the distance between a position and the center line in width of the slab is x, the displacement y of the position relative to the coordinates (0,0) of the middle position of the head top may be calculated according to the following expression:

$$\begin{cases} y = 0 & \text{if } \text{abs}(x) \le \frac{W'}{2} \\ y = \frac{2H}{W - W'}\text{abs}(x) & \text{if } \frac{W'}{2} \le \text{abs}(x) \le \frac{W}{2} \end{cases}$$

Figure 9:
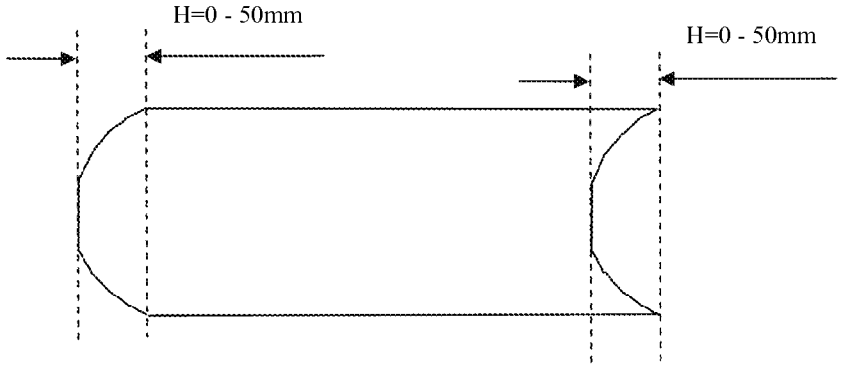
FIG. 9 is the schematic view of the multi-broken line cutting method according to the present invention.

6. The multi-broken line pre-control cutting method, as shown in FIG. 9. The multi broken lines are used to form the shape—the head of the slab concaving inwards and the tail thereof projecting outwards.

Embodiments

To testify the effect of the method of pre-controlling the slab head and tail shapes, a cutting and rolling test is done in the hot rolling line. In the test, the way of pre-controlling the slab head and tail shapes, the head and tail cut amount of the intermediate slab after rolling and the effect for reducing the cut amount is described.

The conditions of the slab: to testify the effect of pre-controlling the shapes of the slab head and tail under different arc heights, four groups of tests are designed. In each group of test, two slabs with the identical thickness and width is selected, one of which is used for the head and tail pre-control process (the arc at the head assumes concaving and that at the tail assumes projecting), and another is a conventional cuboid slab for comparison. Eight slabs are selected, the relative data of which is shown in the tables 1-1 to 1-4.

TABLE 1-1

The First Group Of Test Slabs (Unit: mm)

| No. | Steel No. | Precontrol Flag | Head Arc Height | Tail Arc Height | Slab Thickness | Slab Width | Target Steel Thickness | Target Steel Thickness |
|---|---|---|---|---|---|---|---|---|
| 1-1 | 13170551 | Yes | 8 | 10 | 230 | 1150 | 3.01 | 1044 |
| 1-2 | 13170552 | No | 0 | 0 | 230 | 1150 | 3.01 | 1044 |

TABLE 1-2

The Second Group Of Test Slabs (Unit: mm)

| No. | Steel No. | Precontrol Flag | Head Arc Height | Tail Arc Height | Slab Thickness | Slab Width | Target Steel Thickness | Target Steel Thickness |
|---|---|---|---|---|---|---|---|---|
| 2-1 | 13170545 | Yes | 19 | 18 | 230 | 1150 | 3.97 | 1121 |
| 2-2 | 13170546 | No | 0 | 0 | 230 | 1150 | 3.97 | 1121 |

TABLE 1-3

The Third Group Of Test Slabs (Unit: mm)

| No. | Steel No. | Precontrol Flag | Head Arc Height | Tail Arc Height | Slab Thickness | Slab Width | Target Steel Thickness | Target Steel Thickness |
|---|---|---|---|---|---|---|---|---|
| 3-1 | 13170548 | Yes | 20 | 23 | 230 | 1150 | 3.53 | 1080 |
| 3-2 | 13170549 | No | 0 | 0 | 230 | 1150 | 3.53 | 1080 |

TABLE 1-4

The Fourth Group Of Test Slabs (Unit: mm)

| No. | Steel No. | Precontrol Flag | Head Arc Height | Tail Arc Height | Slab Thickness | Slab Width | Target Steel Thickness | Target Steel Thickness |
|---|---|---|---|---|---|---|---|---|
| 4-1 | 1317065 | Yes | 35 | 38 | 230 | 1000 | 4.97 | 979 |
| 4-2 | 1317066 | No | 0 | 0 | 230 | 1000 | 4.97 | 979 |

The method of pre-controlling the shapes of the slab head and tail used in the tests is the circle arc line control method.

In each group of tests, the slab is processed by the same heating and rolling technique. The results of the cut amount at the head and tail of the intermediate slab is shown in tables 2-1 to 2-4, wherein the cut area is the graph area of the head and tail shape detector, but not the surface area of the real thing.

TABLE 2-1

The First Test Slab Result (Unit of Cut Surface Area: $cm^2$)

| No. | Steel No. | Precontrol Flag | Head Arc Height | Tail Arc Height | Cut Head Area | Cut Tail Area | Total Cut Area | Optimize Effect |
|---|---|---|---|---|---|---|---|---|
| 1-1 | 13170551 | Yes | 8 | 10 | 15.01 | 14.86 | 29.87 | 5.59% |
| 1-2 | 13170552 | No | 0 | 0 | 20.86 | 10.78 | 31.64 | |

TABLE 2-2

The Second Test Slab Result (Unit of Cut Surface Area: $cm^2$)

| No. | Steel No. | Precontrol Flag | Head Arc Height | Tail Arc Height | Cut Head Area | Cut Tail Area | Total Cut Area | Optimize Effect |
|---|---|---|---|---|---|---|---|---|
| 2-1 | 13170545 | Yes | 19 | 18 | 10.91 | 10.14 | 21.05 | 35.56% |
| 2-2 | 13170546 | No | 0 | 0 | 15.11 | 17.56 | 32.67 | |

TABLE 2-3

The Third Test Slab Result (Unit of Cut Surface Area: $cm^2$)

| No. | Steel No. | Precontrol Flag | Head Arc Height | Tail Arc Height | Cut Head Area | Cut Tail Area | Total Cut Area | Optimize Effect |
|---|---|---|---|---|---|---|---|---|
| 3-1 | 13170548 | Yes | 20 | 23 | 10.75 | 14.41 | 25.16 | 20.48% |
| 3-2 | 13170549 | No | 0 | 0 | 19.74 | 11.9 | 31.64 | |

TABLE 2-4

The Fourth Test Slab Result (Unit of Cut Surface Area: $cm^2$)

| No. | Steel No. | Precontrol Flag | Head Arc Height | Tail Arc Height | Cut Head Area | Cut Tail Area | Total Cut Area | Optimize Effect |
|---|---|---|---|---|---|---|---|---|
| 4-1 | 1317065 | Yes | 35 | 38 | 15.01 | 14.86 | 29.87 | 4.62% |
| 4-2 | 1317066 | No | 0 | 0 | 17.35 | 13.97 | 31.32 | |

Conclusion: the aforementioned four groups of test results show that all the cut amounts of the head and tail of the intermediate slab after rough rolling drops after being pre-controlled in shapes. There are different cut amount drop extents under different arc heights, and in the test conditions, the highest drop extent is 35.56%, which is a remarkable effect.

The description above is only the preferred embodiment of the present invention, but not used for limiting the protection scope of the present invention, therefore, any modification, equivalent alternative, improvement and the like within the spirit and principle of the present invention shall fall into the protection scope of the present invention.

The invention claimed is:

1. A method of pre-controlling shapes of continuous-casting slab's head and tail for reducing a cut amount of the head and tail of hot rolling intermediate slab, comprising:

cutting at a position at the slab's head and tail a displacement y, wherein the displacement y is relative to a coordinate of an arc top of the slab, the (x, y) coordinate of the arc top of the slab is (0,0), x is a distance between a position and a center line of a width W of the slab, and the displacement y is calculated according to one of the following expressions, wherein H is an arc height which is a maximum value of a concave amount at the head or a projection amount at the tail $$y = \frac{2H}{W}\text{abs}(x), \text{ wherein } -\frac{W}{2} \le x \le \frac{W}{2}, \text{ and} \quad \text{(i)}$$

wherein the resulting shape of the curve is a broken line symmetric to the center line of a width W of the slab; and $$\begin{cases} y = 0 & \text{if abs}(x) \le \frac{W'}{2} \\ y = \frac{2H}{W - W'}\text{abs}(x) & \text{if } \frac{W'}{2} \le \text{abs}(x) \le \frac{W}{2} \end{cases} \quad \text{(ii)}$$

wherein W' is an adjustable width, and wherein the resulting shape of the curve is a trapezoid and is symmetric to the center line of a width W of the slab; and wherein H being set between 15 mm and 30 mm, and cutting the slab into a shape according to one of the expressions results with an end surface of its head concaving inwards and an end surface of its tail projecting outwards.

2. The method of pre-controlling the shapes of continuous-casting slab's head and tail according to claim 1, characterized in that a head shape of the slab matches with a tail shape of a slab produced prior to the slab, and the tail shape of the slab matches with the head shape of a slab produced after the slab, that is, the slab produced prior to the slab and the slab produced after the slab are cut from the same continuous-casting slab.

3. The method of pre-controlling the shapes of continuous-casting slab's head and tail according to claim 1, characterized in that the curve is a broken and straight line, when the slab is wide, the head and tail of the slab are cut in an adjustable width of the middle part according to item (i) described in claim 1, two sides of the middle part are cut to a straight line, and the middle part and its two sides combine together to form the head and tail shapes.

* * * * *